US008910745B2

(12) United States Patent
Latka

(10) Patent No.: US 8,910,745 B2
(45) Date of Patent: Dec. 16, 2014

(54) PORTED WEAPON SILENCER WITH SPIRAL DIFFUSER

(71) Applicants: GSL Technology, Inc., Jackson, MI (US); Gemtech, Boise, ID (US)

(72) Inventor: Gregory S. Latka, Jackson, MI (US)

(73) Assignees: GSL Technology, Inc., Jackson, MI (US); Gemtech, Boise, ID (US)

( * ) Notice: Subject to any disclaimer, the term of this patent is extended or adjusted under 35 U.S.C. 154(b) by 0 days.

(21) Appl. No.: 14/178,809

(22) Filed: Feb. 12, 2014

(65) Prior Publication Data

US 2014/0318887 A1 Oct. 30, 2014

Related U.S. Application Data

(60) Provisional application No. 61/763,522, filed on Feb. 12, 2013.

(51) Int. Cl.

| | |
|---|---|
| ***F41A 21/30*** | (2006.01) |
| ***F41A 21/34*** | (2006.01) |
| *F41A 21/00* | (2006.01) |
| *F41A 21/28* | (2006.01) |

(52) U.S. Cl.

CPC ..... *F41A 21/30* (2013.01)
USPC ..... 181/223; 89/14.4; 89/14.3; 89/14.2

(58) Field of Classification Search

CPC ..... F41A 21/00; F41A 21/30; F41A 21/28; F41A 21/34
USPC ..... 181/223; 89/14.4, 14.3, 14.2
See application file for complete search history.

(56) References Cited

U.S. PATENT DOCUMENTS

| | | | | |
|---|---|---|---|---|
| 1,017,003 | A | | 2/1912 | Kenney |
| 1,111,202 | A | * | 9/1914 | Westfall ..... 89/14.4 |
| 1,341,363 | A | | 5/1920 | Fiala |
| 1,427,802 | A | * | 9/1922 | Goodwin ..... 181/223 |
| 1,770,471 | A | * | 7/1930 | Hatcher ..... 89/14.3 |
| 2,792,760 | A | | 5/1957 | Hammer |
| 3,500,955 | A | | 3/1970 | Werbell |
| 3,667,570 | A | | 6/1972 | WerBell, III |
| 4,291,610 | A | | 9/1981 | Waiser |

(Continued)

FOREIGN PATENT DOCUMENTS

| | | | |
|---|---|---|---|
| GB | 356224 | * | 8/1931 |
| GB | 579168 | * | 7/1946 |
| GB | 757640 | * | 9/1956 |
| GB | 966934 | * | 8/1964 |

*Primary Examiner* — Edgardo San Martin
(74) *Attorney, Agent, or Firm* — Young Basile Hanlon & MacFarlane P.C.

(57) ABSTRACT

A firearm muzzle silencer includes an elongated cylindrical body having a cylindrical bore, a firearm mounting end, and a projectile discharge end. At least one helical insert is positioned in the cylindrical bore and proximate to the firearm mounting end. The helical insert has an insert axial bore that extends through the helical insert and a spiral groove formed on an exterior of the helical insert to define a spiral path between the helical insert and the cylindrical bore. A chamber is defined in the elongated cylindrical body adjacent to the helical insert, and the helical insert is positioned between the chamber and the firearm mounting end. A plurality of ports is formed in the elongated cylindrical body adjacent to the spiral path, wherein the plurality of ports is in communication with the chamber via the spiral path.

14 Claims, 2 Drawing Sheets

(56) References Cited

U.S. PATENT DOCUMENTS

| | | | | | |
|---|---|---|---|---|---|
| 4,576,083 | A | | 3/1986 | Seberger, Jr. | |
| 4,879,942 | A | * | 11/1989 | Cave | 89/14.3 |
| 4,907,488 | A | * | 3/1990 | Seberger | 89/14.4 |
| 5,029,512 | A | | 7/1991 | Latka | |
| 5,036,747 | A | * | 8/1991 | McClain, III | 89/14.3 |
| 6,374,718 | B1 | * | 4/2002 | Rescigno et al. | 89/14.4 |
| 6,575,074 | B1 | * | 6/2003 | Gaddini | 89/14.4 |
| 7,237,467 | B1 | * | 7/2007 | Melton | 89/14.4 |
| 7,594,464 | B2 | * | 9/2009 | Dueck | 89/14.4 |
| 7,832,323 | B1 | * | 11/2010 | Davies | 89/14.4 |
| 8,087,338 | B1 | * | 1/2012 | Hines | 89/14.4 |
| 8,100,224 | B1 | * | 1/2012 | Olson | 181/223 |
| 8,322,266 | B2 | * | 12/2012 | Presz et al. | 89/14.4 |
| 8,453,789 | B1 | * | 6/2013 | Honigmann et al. | 181/223 |
| 8,511,425 | B2 | * | 8/2013 | Larue | 181/223 |
| 8,695,475 | B2 | * | 4/2014 | Schneider | 89/14.3 |
| 8,739,922 | B2 | * | 6/2014 | Wirth et al. | 181/223 |
| 2014/0216237 | A1 | * | 8/2014 | Butler | 89/14.4 |
| 2014/0224574 | A1 | * | 8/2014 | Latka | 181/223 |

* cited by examiner

PORTED WEAPON SILENCER WITH SPIRAL DIFFUSER

CROSS-REFERENCE TO RELATED APPLICATIONS

This application claims the benefit of U.S. Provisional Application No. 61/763,522 filed 12 Feb. 2013.

TECHNICAL FIELD

This disclosure relates generally to the field of firearm muzzle silencers.

BACKGROUND

Firearm muzzle silencers can absorb and reduce the audible frequencies and vibrations occurring from the rapid expansion of gases leaving a firearm muzzle as a projectile leaves the gun bore. Such devices, in addition to reducing audible frequencies, can also contain and arrest muzzle flash. Silencers, conventionally, are designed to temporarily contain and divert the expanding gases, and as a result, effective firearm silencers can be relatively large and bulky so that they can accommodate the large volume of expanding gas, especially with higher caliber firearms.

SUMMARY OF THE INVENTION

One aspect of the disclosed embodiments is a firearm muzzle silencer that includes a firearm muzzle silencer includes an elongated cylindrical body having a cylindrical bore, a firearm mounting end, and a projectile discharge end. At least one helical insert is positioned in the cylindrical bore and proximate to the firearm mounting end. The helical insert has an insert axial bore that extends through the helical insert and a spiral groove formed on an exterior of the helical insert to define a spiral path between the helical insert and the cylindrical bore. A chamber is defined in the elongated cylindrical body adjacent to the helical insert, wherein the helical insert is positioned between adjacent to the helical insert and the helical insert is positioned between the chamber and the firearm mounting end. A plurality of ports is formed in the elongated cylindrical body adjacent to the spiral path, wherein the plurality of ports is in communication with the chamber via the spiral path.

Another aspect of the disclosed embodiments is a method of silencing a firearm that includes firing a projectile through a silencer having an elongated cylindrical body having a cylindrical bore within which is inserted helical insert having a spiral path formed by grooves on an exterior of the helical insert and adjacent the cylindrical bore operative to communicate from a chamber internal to the elongated cylindrical body to the exterior of the elongated cylindrical body via one or more ports formed in the elongated cylindrical body wherein the chamber is distal to a firearm mounting end of the elongated cylindrical body and wherein the ports are proximate to the firearm mounting end; capturing a portion of gasses and sound waves emitted from the firearm at the chamber; communicating a portion of the gasses and sound waves from the chamber to the one or more ports via the spiral path, wherein a direction in which the gasses and sound waves is communicated via the spiral path is counter to a direction with which the projectile passes through the silencer.

Another aspect of the disclosed embodiments is a method of manufacturing a firearm silencer that includes forming an elongated cylindrical body having a cylindrical bore; forming a firearm mounting adaptor and an end cap, each having an axial bore; mounting the firearm mounting adaptor and the end cap on the elongate cylindrical body; forming a helical insert having an axial bore and threads formed exterior to the helical insert and sized to fit closely within the cylindrical bore to form a spiral path between the helical insert and the cylindrical bore and a chamber when the helical insert is inserted into the cylindrical bore; inserting the helical insert into the cylindrical bore and proximate to the firearm mounting adaptor; forming holes in the elongated cylindrical body, proximate to the firearm mounting adaptor configured to communicate from the outside of the cylindrical body to the chamber; forming a plurality of baffles having axial bores; and inserting the plurality of baffles into the cylindrical bore between the helical insert and the end cap so that the axial bores of the plurality of baffles, the axial bore of the helical insert and the axial bores of the firearm mounting adaptor and the end cap are aligned on a common axis and cooperate to permit a projectile to be fired through the axial bores.

BRIEF DESCRIPTION OF THE DRAWINGS

The objects and advantages of the invention will be appreciated from the following description and accompanying drawings wherein.

DETAILED DESCRIPTION

The description relates to ported weapon silencers that have a spiral diffuser. The weapon silencers disclosed herein can include gas expansion chambers and a plurality of baffles having bores permitting gas expansion and exterior vanes defining an elongated gas flow path to decelerate and cool the expanding gases. As a result, the weapon silencers disclosed herein effectively confine audible frequencies and muzzle flash in a body of concise axial configuration, while being economical, easy to assemble, rugged, and readily serviceable by the unskilled.

Figure 1:
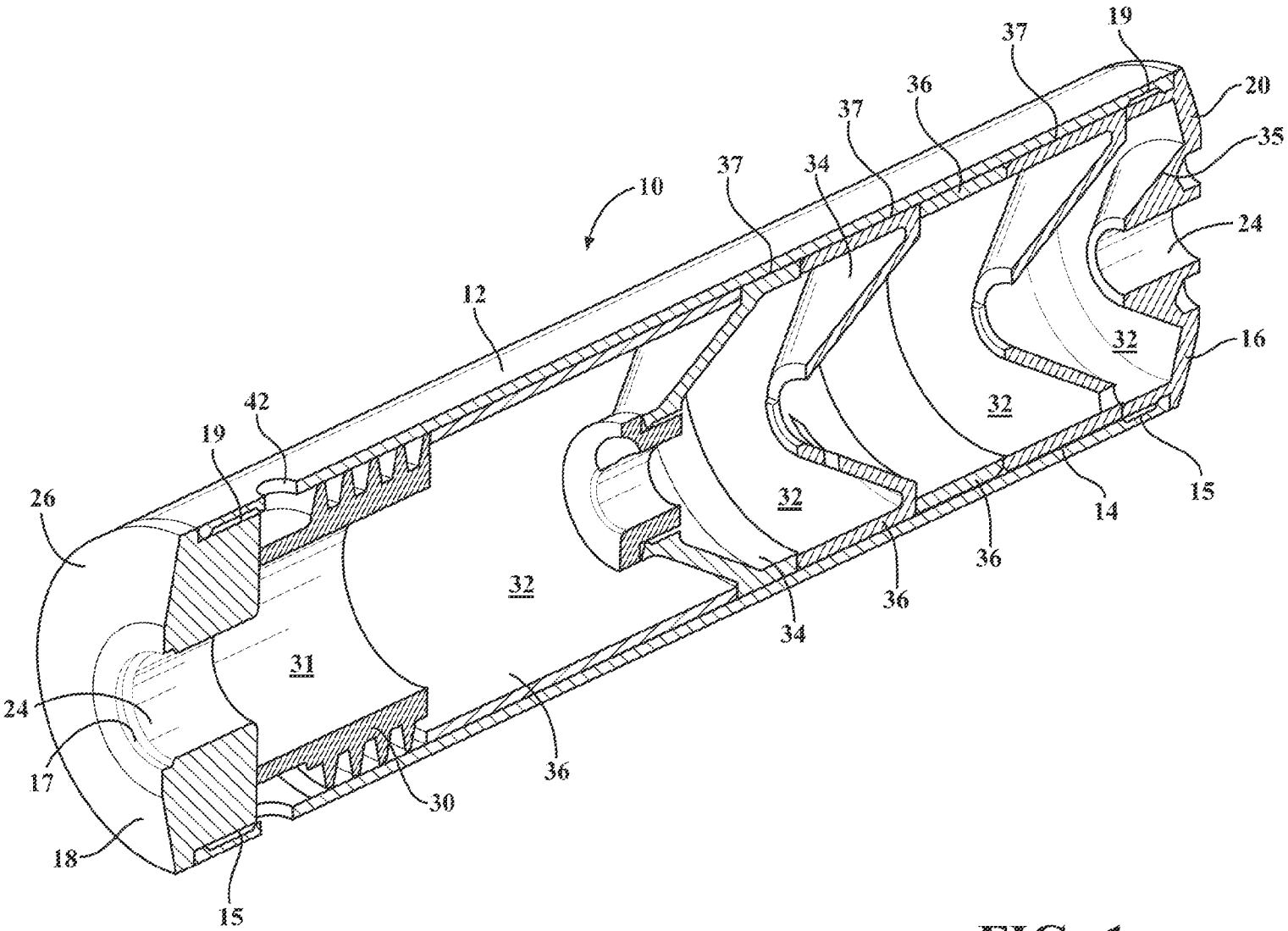
FIG. 1 is a perspective cross-sectional view of a weapon silencer.

A silencer 10 for a weapon such as a firearm is illustrated in perspective cross-sectional view in FIG. 1. The silencer 10 includes an elongated cylindrical body 12 having a cylindrical bore 14 extending there through. The cylindrical body 12 extends from an inlet end 18 to an outlet end 16. The inlet end 18 is also referred to herein as a firearm mounting end, as it is the end of the silencer 10 at which the firearm is attachable. The outlet end 16 is also referred to herein as a projectile discharge end, as it is the end of the silencer 10 at which a projectile will exit the silencer 10.

Internally, the cylindrical bore 14 is provided with threads 15 for engagement of an end cap 20 at the outlet end 16 of the elongated cylindrical body 12. The cylindrical bore 14 is also provided with threads 15 at the inlet end 18 of the cylindrical bore 14 for engagement of a mounting adaptor 26. In this fashion, the mounting adapter 26 and end cap 20 may be selectively disassembled from the elongated cylindrical body 12, thereby providing access to the interior of the silencer 10 and the individual components contained therein. The threads 15 can be machined into the interior surface of the cylindrical bore 14 to maintain an unobstructed inner surface in the cylindrical bore 14 between inlet end 18 and outlet end 16 to permit internal components of the silencer to be easily inserted and removed from the cylindrical bore without requiring tools or unthreading.

The mounting adaptor 26 is mounted at the inlet end 18 of the silencer 10 using threads 15 and mounting adaptor threads 19. The mounting adaptor 26 is provided with an axial bore 24 having threads 17. Threads 17 serve to facilitate engagement of the silencer 10 with the muzzle of the firearm to which the silencer 10 can be attached. The inlet bore 24 is larger in diameter than the projectile that will pass through the silencer.

Internal components of the silencer 10, including a helical insert 30, baffles 34 and spacers 36, can be constructed with annular outer surfaces that are sized and finished to fit closely within the cylindrical bore 14 in order to prevent any substantial amount of expanding gasses within the silencer body from passing between the cylindrical outer surfaces and the cylindrical bore 14 while permitting the components to be removed without requiring tools or unthreading of components. In this way the individual components can be inserted and removed from the cylindrical bore 14 quickly and easily by removing one or both of the mounting adaptor 26 or end cap 20. The individual components are not permanently attached to the cylindrical body 12, the mounting adapter 26, end cap 20 or each other, permitting the individual parts to slide out of the cylindrical bore once one or more of the mounting adaptor 26 or end cap 20 is removed. This permits an individual part to be replaced or reworked easily and individually without requiring further disassembly or replacement of other parts, for example.

A helical inset 30 can be positioned proximate the inlet end 18 of the silencer 10. The helical insert 30 is provided with a helical thread 48 on its outer periphery. The helical insert 30 can be mounted coaxially with the elongated cylindrical body 12 and internal thereto. When mounted coaxially with the elongated cylindrical body 12, the helical thread 48 on the exterior of the helical insert can be positioned adjacent to the cylindrical bore 14 thereby forming a spiral path 49 between the helical insert 30 and the cylindrical bore 14. The helical thread 48 can have a closed end and an open end, which can be defined by structural features of the helical insert 30 or by cooperation of the helical insert 30 with other components of the silencer 10. In the illustrated example, the helical insert is disposed within the cylindrical body 12 adjacent to and in engagement with the mounting adaptor 26, which defines the closed end for the helical thread 48 adjacent to the mounting adaptor 26, with the open end of the helical thread 48 being opposite the mounting adaptor 26.

The helical insert 30 has a cylindrical hollow bore or internal chamber 31 which transfers gases and by-products of combustion as well as sonic energy from the weapon muzzle via axial bore 24 of the mounting adaptor 26 through the internal chamber 31 and then to internal chamber 32 where the spiral path 49 external to the helical insert 30 and in communication with chamber 32 can direct a portion of the gases, sound energy and by-products of combustion in a spiral fashion to a plurality of ports 42 located in the cylindrical body 12. Ports 42 extend through the cylindrical body 12 from the cylindrical bore 14 to an exterior of the cylindrical body 12, thereby allowing a measured portion of the gases, by-products of combustion and sound energy to be discharged from the interior of the silencer 10. The gases can dissipate pressure and sonic energy in the course of following the spiral path 49 formed by the helical thread 48, thereby reducing or eliminating muzzle flash and audible frequencies. One or more such helical inserts 30 can be provided interior to the body 12, in association with one or more ports 42 in communication therewith.

The chamber 32, spiral path 49 and ports 42 can be arranged so that the gasses, sound energy and by-products of combustion are directed from the interior of the silencer 10 to the exterior by a path that travels, at least in part, in a direction opposite the direction of travel of a projectile through the silencer 10. In particular, fluid communication between the inlet end 18 and the ports 42 is established by a flow path that includes the axial bore or internal chamber 31 of the helical insert 30, the chamber 32, and the spiral path 49. Fluid communication between the inlet end 18 and the ports 42 by shorter flow paths can be substantially blocked or sealed. Thus, gasses, sound energy and by-products of combustion that accompany a projectile fired from the barrel of a gun pass through the internal chamber 31 of the helical insert 30 to the chamber 32 where a portion of the gasses, sound energy and by-products of combustion enter the open end of the spiral path 49 as a result of pressure within the chamber 32, and are directed by the spiral path 49 in a direction back towards the inlet end 18 of the silencer 10 to be emitted from the ports 42 near the inlet end 18. Because the gasses, sound energy, and other by-products of combustion traverse this length of the silencer 10 twice, along with the additional distance caused by traveling through the spiral path, the silencer 10 can further dissipate the sound and muzzle flash that accompanies a projectile as it is fired while reducing the necessary length of the silencer 10.

The elongated cylindrical body 12 also includes a plurality of baffles 34 arranged end-to-end within the elongated cylindrical body 12. Each baffle 34 includes an axial bore 24, a frusto-conical section 52 and an annular section 37. The axial bore 24 is also referred to herein as a baffle axial bore. The baffles 34 can be arranged so that the axial bores 24 are on a common axis with the axial bores 24 of the mounting adaptor 26 and the end cap 20 to permit a projectile to be fired by the firearm through the silencer 10. The frusto-conical sections 52 are arranged having the small or apical end of the frusto-conical section 52 at the axial bore 24 and the large or base end of the frusto-conical section at the annular section 37 adjacent the cylindrical bore 14.

Figure 3:
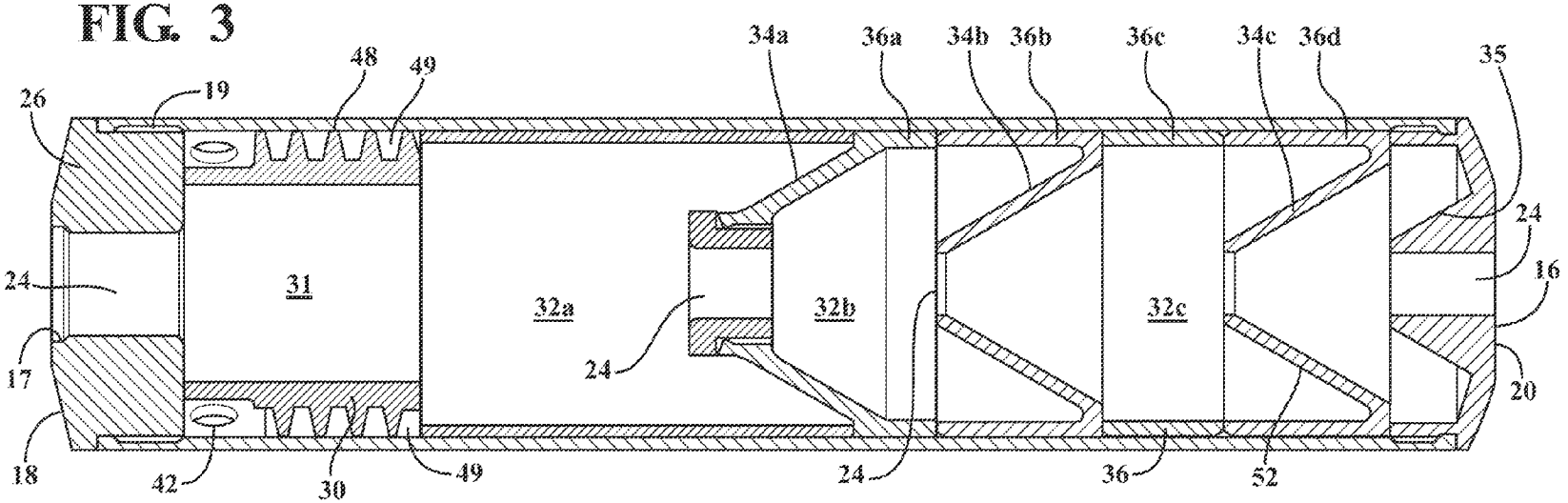
FIG. 3 is a cross-sectional view of the weapon silencer.

FIG. 3 shows baffles 34*a*, 34*b*, 34*c* arranged spaced apart and end-to-end in the cylindrical bore 14 separated by spacers 36*a*, 36*b*, 36*c*, 36*d* which can be made separate from the baffle 34*a*, 34*b*, 34*c* or can be formed integrally with one of the baffles 34*a*, 34*b*, 34*c*. For example, baffle 34*a* included spacer 36*a*, while spacer 36*c* is separate from baffles 34*b* and 34*c*. The baffles 34*a*, 34*b*, 34*c*, spacers 36*a*, 36*b*, 36*c*, 36*d*, the helical insert 30 and the end cap 20 cooperate within the cylindrical bore 14 to form chambers 32*a*, 32*b*, 32*c*, and 32*d*. Internally, each baffle 34 includes a frusto-conical section 52 of expanding volume in the direction of projectile and gas movement, and externally, each baffle 34 includes smooth frusto-conical exterior and interior surfaces between the axial bore 24 and annular section 37. The output end of each baffle 34 is larger in diameter than the input end, thereby allowing for expansion of the gases and by-products of combustion and sonic energy as those gases, by-products and energy traverse the silencer from one end to the opposite end of said silencer 10.

When the firearm to which the silencer 10 is affixed is discharged, the projectile from the firearm can pass from the firearm muzzle, through the bore 24 and the mounting adaptor 26, through the helical insert 30, through the bores 24 of the baffles 34, exiting bore 24 in cap 20. The mounting adaptor 26, cap 20 and baffles 34 share a common axis to insure that the projectile fired from the firearm exits cleanly through the silencer without interference from the silencer's components.

A final expansion chamber 32*d* is defined adjacent the silencer end cap 20 wherein the end cap 20 can include a shrouded bore 35, which can confine and restrict gas flow through the end cap 20, adding to the audible suppression produced by the silencer 10.

Figure 2:
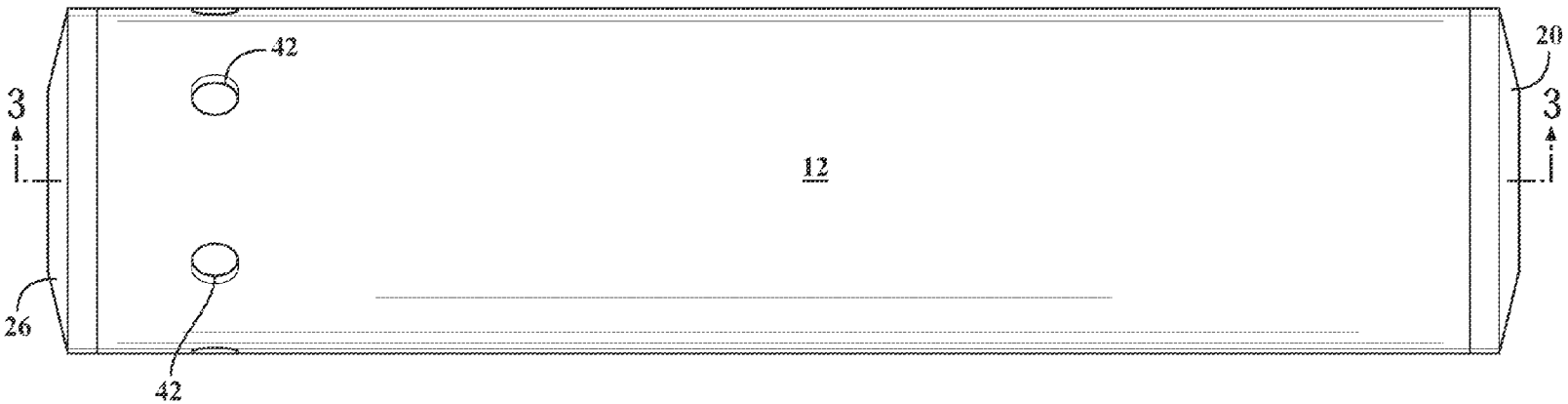
FIG. 2 is a side view of the weapon silencer.

With reference to FIGS. 2 and 3, the interrelation of the helical insert 30, chambers 32 and ports 42 will be best understood. When a projectile is fired from a firearm through a silencer, a substantial volume of combustion gases exit the firearm muzzle ahead of, surrounding and behind the projectile. Also associated with the firing of the weapon is a substantial series of sound waves as evidenced by the loud report associated with gun fire, which is a function of the explosion taking place and the gun powder used to fire the projectile. The hot gases, by-products of combustion and sound waves result in not only a report, but a substantial muzzle flash which can be readily visible, particularly in dim light or during hours of darkness. For the combat use of weapons by soldiers, for example, the report and associated muzzle flash can present significant dangers, serving to enunciate the precise position of the firearm and its user. The silencer 10 is configured, accordingly, to attenuate the sound and muzzle flash within the cylindrical bore 14 of elongated cylindrical body 12 of silencer 10.

During use of the silencer 10, the outrush of gases and sound waves that accompany a projectile enters bore 24 at inlet end 18 then passes into insert chamber 31, which is in communication with first baffle chamber 32*a*. These gases, by-products of combustion and sonic waves expand and can become turbulent in first chamber 32*a*. A portion of the by-products, gases and sonic energy enters bore 24 of baffle 34*a*, while a further portion of the gases, by-products and sonic energy enter the spiral path 49 formed in the helical insert 30. As the gases, by-products and sonic energy enter the spiral path 49 of helical insert 30, their direction of travel is confined by helical threads 48 which are in contact with the internal wall of cylindrical bore 14. Ultimately, the gases, by-products and sonic energy so directed through spiral path 49 reaches ports 42 where, substantial energy having been dissipated, the remaining gases, by-products and sonic energy are ejected from the cylindrical body 12.

Those gases, by-products and sonic energy which pass through bore 24 of baffle 34*a* then enter chamber 32*b* where further expansion and turbulence can reduce the pressure and sonic energy further. This now diminished pressure, temperature and sound waves are transmitted through baffle 34*b* into chamber 32*c*, where still further reductions in pressure, temperature and sound can take place as a result of the turbulence caused in chamber 32*c*. Thereafter, the pressure, heat energy and sonic energy is transmitted through baffle 34*c*, following which further diffusion occurs prior to the gases, by-products and sounds exiting bore 24. Finally the remaining gases, by-products and sonic energy can enter a final chamber 32*d* wherein further reductions in pressure and temperature take place. A portion of the gases, by-products and sonic energy can exit the silencer 10 via axial bore 24 of end cap 20. The axial bore 24 of end cap 20 can be formed in a shrouded bore 35 to further restrict the flow of gasses, by-products and sonic energy from the silencer 10 to the exterior.

Although the above embodiment discloses only one helical insert, it will be appreciated that successive helical inserts 30 and successive ports 42 may be positioned longitudinally along elongated cylindrical body 12 to encourage further dissipation of gases, by-products and sonic energy from the silencer 10 as the by-products of combustion move longitudinally along the length of the silencer 10. When using multiple baffles in this configuration, the principles and concepts are similar to those previously described.

It will be appreciated that various other modifications of the inventive concepts may be apparent to those skilled in the art.

I claim:

1. A firearm muzzle silencer comprising:

an elongated cylindrical body having a cylindrical bore, a firearm mounting end, and a projectile discharge end;

at least one helical insert positioned in the cylindrical bore and proximate to the firearm mounting end, the helical insert having an insert axial bore that extends through the helical insert and a spiral groove formed on an exterior of the helical insert to define a spiral path between the helical insert and the cylindrical bore;

a chamber defined in the elongated cylindrical body adjacent to the helical insert, and the helical insert is positioned between the chamber and the firearm mounting end; and a plurality of ports is formed in the elongated cylindrical body adjacent to the spiral path, wherein the plurality of ports is in communication with the chamber via the spiral path.

2. The firearm muzzle silencer of claim 1, wherein the plurality of ports are positioned near the firearm mounting end.

3. The firearm muzzle silencer of claim 1, wherein fluid communication between the firearm mounting end and the plurality of ports is established by a flow path that includes the axial bore of the helical insert, the chamber, and the spiral path.

4. The firearm muzzle silencer of claim 1, wherein the spiral path extends from an open end at the chamber to the plurality of ports.

5. The firearm muzzle silencer of claim 1, further comprising:

a plurality of baffles that each have a baffle axial bore and are positioned in the cylindrical bore of the elongated cylindrical body between the chamber and the projectile discharge end.

6. The firearm muzzle silencer of claim 5, wherein each baffle from the plurality of baffles includes an annular outer surface that is sized to fit closely within the cylindrical bore and a frusto-conical section in which the baffle axial bore expands diametrically from a first end to a second end.

7. The firearm muzzle silencer of claim 6, wherein the annular outer surface of each baffle cooperates with the cylindrical to prevent expanding gases from passing between the annular outer surface and the cylindrical bore.

8. The firearm muzzle silencer of claim 5, wherein the insert axial bore and the baffle axial bore of each baffle are aligned on a common axis to permit a projectile to pass through.

9. The firearm muzzle silencer of claim 5, wherein the plurality of baffles are positioned in end-to-end fashion to define one or more baffle chambers between within the elongate cylindrical body between adjacent pairs of the baffles.

10. The firearm muzzle silencer of claim 5, wherein at least one spacer is disposed between at least a first pair of baffles from the plurality of baffles.

11. The firearm muzzle silencer of claim 10 wherein the at least one spacer is formed integrally with a first baffle from the plurality of baffles.

12. A method of silencing a firearm comprising:

firing a projectile through a silencer; the silencer having an elongated cylindrical body and a cylindrical bore; the cylindrical bore comprising a helical insert having a spiral path formed by grooves on an exterior of the helical insert and adjacent the cylindrical bore; the helical insert being operative to communicate from an internal chamber of the elongated cylindrical body to the exterior of the elongated cylindrical body via one or more ports formed on the elongated cylindrical body; wherein the chamber is distal to a firearm mounting end of the elongated cylindrical body; and wherein the ports are proximate to the firearm mounting end;

capturing a portion of gasses and sound waves emitted from the firearm at the chamber; and communicating a portion of the gasses and sound waves from the chamber to the one or more ports via the spiral path, wherein a direction in which the gasses and sound waves is communicated via the spiral path is counter to a direction with which the projectile passes through the silencer.

13. The method of claim 12, wherein the silencer has a plurality of baffles axially spaced end-to-end within the cylindrical bore of the elongate cylindrical body thereby forming one or more baffle chambers, the method further comprising:

capturing a portion of the gasses and sound energy in the one or more baffle chambers.

14. A method of manufacturing a firearm silencer comprising:

forming an elongated cylindrical body having a cylindrical bore;

forming a firearm mounting adaptor and an end cap, each having an axial bore;

mounting the firearm mounting adaptor and the end cap on the elongate cylindrical body;

forming a helical insert having an axial bore and threads formed exterior to the helical insert and sized to fit closely within the cylindrical bore to form a spiral path between the helical insert and the cylindrical bore and a chamber when the helical insert is inserted into the cylindrical bore;

inserting the helical insert into the cylindrical bore and proximate to the firearm mounting adaptor;

forming holes in the elongated cylindrical body, proximate to the firearm mounting adaptor configured to communicate from the outside of the cylindrical body to the chamber;

forming a plurality of baffles having axial bores; and inserting the plurality of baffles into the cylindrical bore between the helical insert and the end cap so that the axial bores of the plurality of baffles, the axial bore of the helical insert and the axial bores of the firearm mounting adaptor and the end cap are aligned on a common axis and cooperate to permit a projectile to be fired through the axial bores.

* * * * *